US008844851B2

(12) United States Patent
Solomon

(10) Patent No.: US 8,844,851 B2
(45) Date of Patent: Sep. 30, 2014

(54) CRUSHER DEVICE

(75) Inventor: Mark Solomon, Orefield, PA (US)

(73) Assignee: FLSMIDTH A/S (DK)

( * ) Notice: Subject to any disclaimer, the term of this patent is extended or adjusted under 35 U.S.C. 154(b) by 0 days.

(21) Appl. No.: 13/883,856

(22) PCT Filed: Dec. 29, 2011

(86) PCT No.: PCT/US2011/067690
§ 371 (c)(1),
(2), (4) Date: Oct. 1, 2013

(87) PCT Pub. No.: WO2013/101013
PCT Pub. Date: Jul. 4, 2013

(65) Prior Publication Data

US 2014/0151482 A1 Jun. 5, 2014

(51) Int. Cl.
*B02C 13/09* (2006.01)

(52) U.S. Cl.
CPC ..... *B02C 13/095* (2013.01)
USPC ..... 241/189.1; 241/286; 241/287; 241/290

(58) Field of Classification Search
CPC .. B02C 13/095; B02C 13/2804; B02C 2/045; B02C 13/282
USPC ..... 241/286, 287, 189.1, 290
See application file for complete search history.

(56) References Cited

U.S. PATENT DOCUMENTS

| | | | | |
|---|---|---|---|---|
| 4,017,035 | A * | 4/1977 | Stuttmann | 241/189.1 |
| 4,049,206 | A * | 9/1977 | Konig et al. | 241/73 |
| 5,255,869 | A * | 10/1993 | Smith | 241/189.1 |
| 5,490,636 | A * | 2/1996 | Schrodl | 241/189.1 |
| 5,513,811 | A * | 5/1996 | Phan Hung | 241/189.1 |
| 7,278,596 | B2 * | 10/2007 | Moriya et al. | 241/189.1 |
| 2007/0069053 | A1 * | 3/2007 | Ortoncelli | 241/189.1 |

OTHER PUBLICATIONS

International Search Report and Written Opinion dated Apr. 20, 2012, 8 pages.

* cited by examiner

*Primary Examiner* — Faye Francis
*Assistant Examiner* — Onekki Jolly
(74) *Attorney, Agent, or Firm* — Daniel DeJoseph; Aaron M. Pile; Jeffrey A. Sharp

(57) ABSTRACT

A crusher device includes a frame, a rotating mechanism positioned in the frame, and a plurality of curtains connected to the frame. The curtains are spaced from the rotating mechanism to define a passageway along which material moves while being crushed. A first curtain is connected to the frame via at least one first cylinder. The first curtain is connected to a second curtain via at least one pivotal connection and at least one second cylinder. The at least one second cylinder is retracted automatically when the at least one first cylinder is forcibly retracted to adjust spacing between the first curtain and the rotating mechanism due to an uncrushable. The automatic retraction of the at least one second cylinder rotates the second curtain away from the rotating mechanism. Such movement widens the spacing between the rotating mechanism and the curtains minimizing damage from tramp or uncrushables.

28 Claims, 5 Drawing Sheets

CRUSHER DEVICE

FIELD OF INVENTION

The present invention relates to crusher devices such as impact crushers and hydraulic systems that may be used in crusher devices.

BACKGROUND OF THE INVENTION

Crusher devices such as impact crushers, roller presses, grinding devices or mill devices may be fed material to crush or grind to a smaller size. Examples of an impact crusher, for instance, may be appreciated from U.S. Pat. Nos. 5,890,666 and 7,293,725. Impact crushers may have curtains, or plates that are positioned to impact material to crush material fed to the impact crusher. Examples of crusher devices, such as for example, jaw crushers, impact crushers, vertical impact crushers, horizontal impact crushers or gyratory crushers may also be appreciated from U.S. Pat. Nos. 6,932,289, 6,637,680, 6,375,105, 5,971,306, 5,833,153, 5,323,974, 4,927,089, 4,398,674, 3,976,255, 3,918,648, 3,847,358, 3,315,902, and 2,588,180 and U.S. Patent Application Publication No. 2010/0147985.

During operation of a crusher device, some material that may be fed to the device may be very difficult or impossible for the device to crush. For instance, an uncrushable element such as tramp material may pass through a crusher device. As another example, the uncrushable element may be material that is much harder than the crusher device is designed for crushing. When such uncrushable material is positioned between crushing bodies of a crusher device, the crusher device may experience substantially high pressure. Such high pressure may create problems for the crusher device. For instance, the high pressure can damage the crusher device or may increase the rate of wear experienced by the crusher device. If the crusher device has a hydraulic system, such high pressure may also damage that hydraulic system or increase the wear experienced by components of the hydraulic system.

A new crusher device is needed. Preferably, the new crusher device is configured to permit uncrushable elements to pass through the device quickly to minimize the damage or wear the device may experience while the uncrushable element passes through the device.

SUMMARY OF THE INVENTION

A crusher device is provided herein. Some embodiments of the crusher device may include a frame, a rotating mechanism positioned adjacent to the frame that is rotatable to crush material and a plurality of moveable curtains connected to the frame. The curtains are spaced from the rotating mechanism to at least partially define a passageway along which material moves while being crushed. The curtains may include a first curtain and a second curtain. The first curtain is connected to the frame via at least one first cylinder that is moveable from a retracted position to an extended position. The first curtain is also connected to the second curtain via at least one pivotal connection. At least one second cylinder is connected between the first curtain and the second curtain. The one or more second cylinders are retractable when the at least one first cylinder is retracted to adjust spacing between the first and second curtains and the rotating mechanism. The retraction of the at least one second cylinder rotates the second curtain away from the rotating mechanism and toward the first curtain.

It should be appreciated that the retraction of the at least one second cylinder may permit damage to the crusher device to be reduced or avoided in the event an uncrushable element such as tramp or tramp material passes through the crusher device. In some embodiments of the crusher device, the at least one second cylinder may be automatically retracted when a pressure of the crusher device is determined to be at or above a predetermined pressure threshold. Such a pressure threshold may be, for example, 1,000 psi or 2,000 psi. The pressure threshold setting may depend upon the design objective for the crusher and the environment in which the crusher is used. Safety conditions may also affect the value for the predetermined pressure setting.

The crusher device may be an impact crusher, such as a horizontal impact crusher. The curtains may be plates, breakers, aprons, or other members that are sized and configured to crush material thrown or otherwise moved against the curtains.

In some embodiments of the crusher device, the at least one first cylinder has a first area and a second area. The second area may have a return spring positioned therein and the first area may retain fluid therein. Adjustment of an amount of fluid within the first area may be the only way of adjusting a position of the at least one first cylinder for such embodiments. The at least one second cylinder may also have a first area that retains fluid and a second area that has a return spring. Adjustment of an amount of fluid within the first area of the one or more second cylinders may be the sole way of adjusting a position of the at least one second cylinder.

In certain embodiments, the crusher device may also include a guide that connects the second curtain to the frame. A mechanical stop may be connected to, integral with, positioned adjacent to or positioned on the guide. The mechanical stop prevents the second curtain from moving beyond an extended most position toward the rotating mechanism.

In some embodiments of the crusher device, the curtains may also include a third curtain that is moveably connected to the frame and positioned above the second curtain. The second curtain may also be positioned below the first curtain. In yet other embodiments, additional curtains may also be connected to the frame.

Preferably, the at least one first cylinder is comprised of a plurality of first cylinders, such as two first cylinders or more than two first cylinders. The at least one second cylinder may only be one second cylinder or may be two second cylinders or may be more than two second cylinders.

The crusher device may also include a storage tank and a pump connected to the storage tank. The pump may be actuatable to adjust a position of the second curtain.

Preferably, the first curtain is moveable relative to the second curtain and the second curtain is moveable relative to the first curtain.

In one embodiment, the one or more first cylinders are connected to the one or more second cylinders such that fluid from the one or more first cylinders flows to the one or more second cylinders to retract the one or more second cylinders when the pressure is at or above a predetermined pressure threshold and the one or more first cylinders are retracted. The fluid flowing from the one or more first cylinders may pass through one or more check valves positioned between the one or more first cylinders and one or more second cylinders. When the one or more second cylinders are retracted, fluid may flow from the one or more second cylinders to one or more accumulators connected to the one or more second cylinders or to a storage tank connected to the one or more second cylinders via a relief valve that may be moved to an open position upon a detection of the pressure being at or above the predetermined pressure threshold.

Other embodiments of the crusher device may be impact crushers. Embodiments of the impact crushers may include a frame, a rotating mechanism positioned adjacent to the frame that is rotatable to crush material, and curtains connected to the frame and positioned adjacent to the rotating mechanism. The curtains and the rotating mechanism are spaced apart to at least partially define a passageway along which material moves when being crushed by the impact crusher. The curtains include a first curtain and a second curtain. The first curtain is pivotally connected to the second curtain. At least one first cylinder is connected to the frame. The first curtain is connected to the at least one first cylinder to moveably position the first curtain. At least one second cylinder is connected between the first curtain and the second curtain. Each cylinder of the at least one second cylinder has a piston that is moveable from an extended position to a retracted position. A distal end of the piston is connected to the first curtain or the second curtain. The piston of each of the at least one second cylinder retracts to the retracted position to move the second curtain away from the rotating mechanism and toward the first curtain when a predetermined pressure threshold is detected.

It should be understood that the predetermined pressure threshold may be a predetermined amount of pressure or a value greater than a predetermined amount of pressure. For instance, the threshold may be 1,000 psi or may be any value greater than 1,000 psi.

Some embodiments of the impact crusher may include additional curtains. For instance, some embodiments may include a third curtain positioned above the second curtain. The third curtain may be connected to the frame via one or more third cylinders so the position of the third curtain may be adjusted. Liners may be provided on one or more of the curtains. For instance, a liner may be attached to the first curtain, the second curtain, or the third curtain. It is also contemplated that each curtain may be connected to a respective liner.

In some embodiments, the impact crusher may be configured so that fluid from the one or more first cylinders flows to a portion of the at least one second cylinder to retract the piston of the at least one second cylinder to move the second curtain when the predetermined pressure threshold is detected and the one or more first cylinders are retracted.

Other embodiments of the crusher device may include a frame, a rotating mechanism positioned within the frame, and curtains positioned adjacent to the rotating mechanism. The curtains include a first curtain and a second curtain that is pivotally connected to the first curtain. The crusher device also includes a hydraulic system. The hydraulic system includes at least one first hydraulic actuation mechanism and at least one second hydraulic actuation mechanism. The one or more first hydraulic actuation mechanisms are connected to the first curtain to moveably position the first curtain. The at least one second hydraulic actuation mechanism is connected between the first curtain and the second curtain. Each hydraulic actuation mechanism of the one or more second hydraulic actuation mechanisms is moveable from a first position to a second position. The at least one second hydraulic actuation mechanism moves from the first position to the second position to move the second curtain away from the rotating mechanism and toward the first curtain when a predetermined pressure threshold is detected. Such movement may widen the passageway to permit an uncrushable element to more quickly pass through the crusher device, which can reduce the wear experienced by components of the crusher device.

It should be understood that the one or more hydraulic actuation mechanisms may be cylinders that have pistons that are moveable from an extended position to a retracted position.

In some embodiments of the crusher device, the hydraulic system may also include a tank that stores fluid connected to the frame and at least one pump connected to the tank. The at least one pump may include a first pump that is actuated to move fluid from the tank to the one or more second cylinders to retract the at least one second cylinder. The first pump may be actuated after a predetermined pressure threshold is detected or when the predetermined pressure threshold is detected.

In alternative embodiments, the fluid may move from the one or more first cylinders to the one or more second cylinders to retract the one or more second cylinders to move the second cylinder upon a retraction of the one or more first cylinders that occurs due to the presence of an uncrushable element. The fluid expelled from a retraction of the one or more first cylinders may be moved toward the one or more second cylinders to retract the piston of the one or more second cylinders. The movement of the fluid from the one or more first cylinders to the one or more second cylinders via hydraulic linkage between these cylinders may permit an automatic retraction of both the first and second cylinders. Such an embodiment may result in retraction of the first and second cylinders to occur more quickly than the actuation of any pumps for providing such movement of the curtains.

The hydraulic system may also include a relief valve connected between the tank and the one or more second cylinders. The relief valve may be opened when the first pump is actuated or after the predetermined pressure threshold is detected and before the first pump is actuated. Fluid may be expelled from the one or more second cylinders and sent to the tank via the opened relief valve when the one or more second cylinders are retracted.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of crusher devices and methods of making and using the same are shown in the accompanying drawings.

DETAILED DESCRIPTION OF PRESENT PREFERRED EMBODIMENTS

Figure 1:
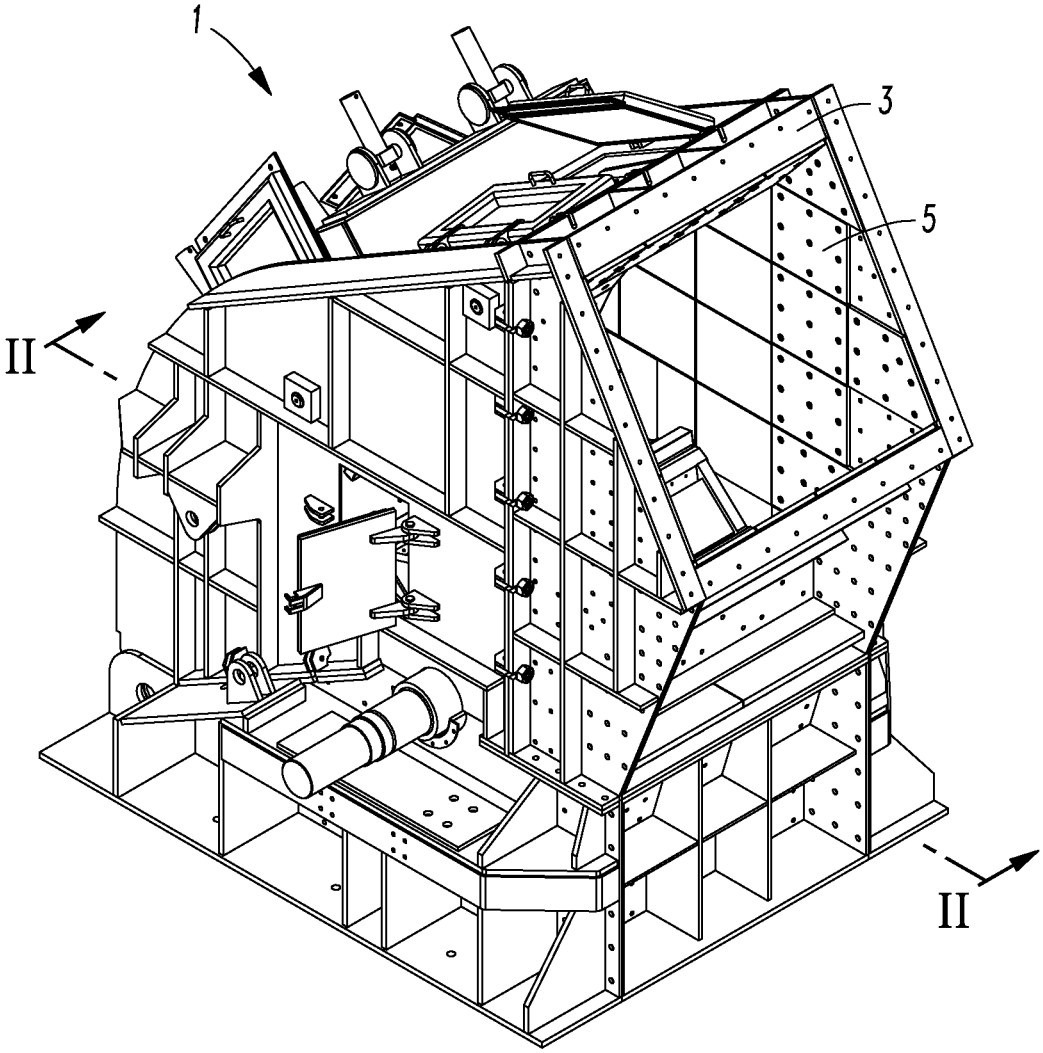
FIG. 1 is a perspective view of a first present preferred crusher device.
Figure 2:
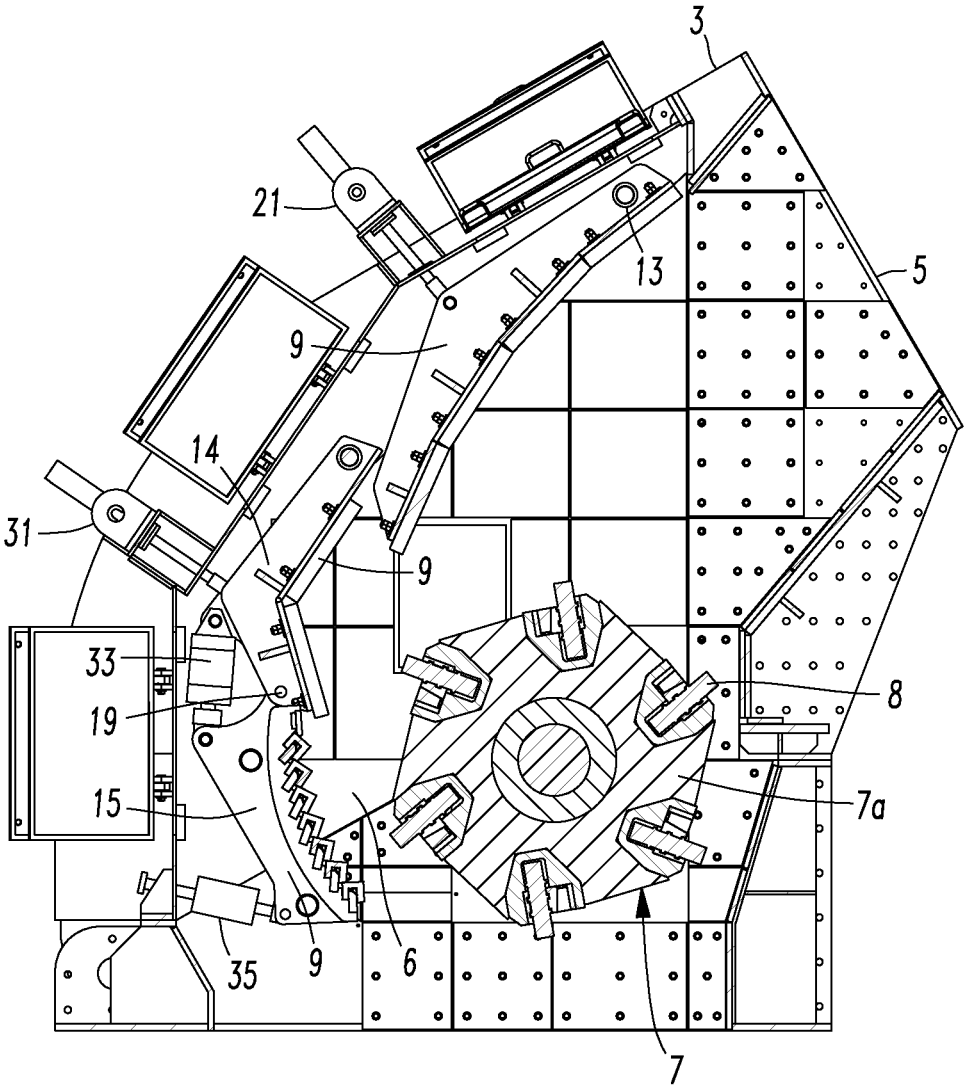
FIG. 2 is a cross sectional view of the first present preferred crusher device taken along line II-II in FIG. 1.
Figure 3:
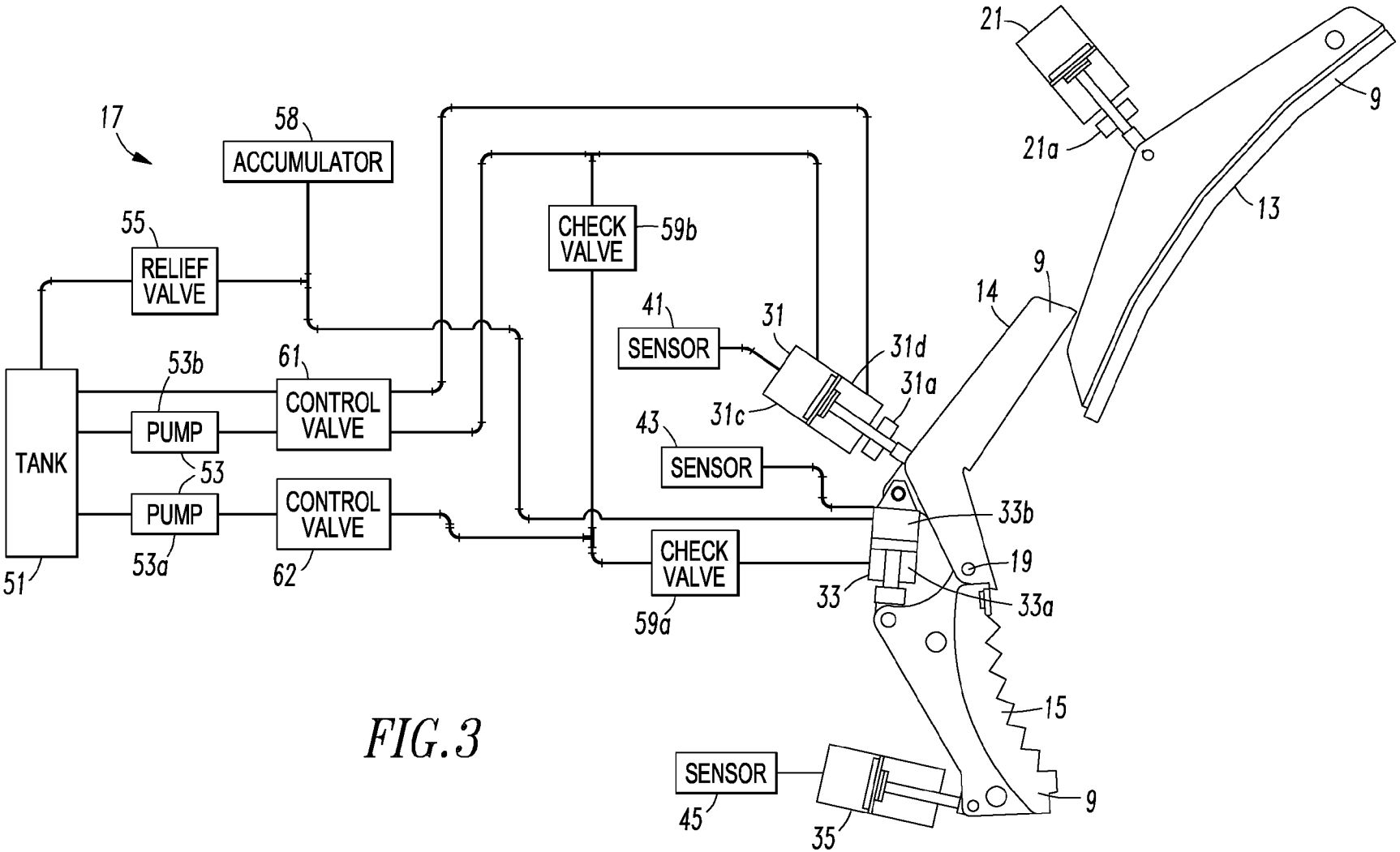
FIG. 3 is a schematic view of a present preferred hydraulic system that may be utilized in the first present preferred embodiment of the crusher device.

Referring to FIGS. 1-3, an impact crusher device 1 has a housing or frame 3 that contains or supports other elements of the crusher. Material is fed through an input opening 5 of the crusher. The material fed to the crusher may be agglomerated material, gravel, stone, rock, ore, or other materials to be crushed or comminuted by the crusher device 1.

Material fed into the crusher is rotated by a rotating mechanism 7. The rotating mechanism may include a rotor 7*a* such as a high inertia rotor, an impeller or another type of rotor. The rotating mechanism 7 may also include hammer members 8 such as hammers, hammer bars, or anvils. The hammer members 8 are attached to the rotor 7*a* so that the hammer members rotate when the rotor rotates. The hammer members may be configured to help crush material or move material against curtains 9 to crush the material when the rotating mechanism 7 rotates.

The rotating mechanism 7 moves the material so that the material is thrown, pushed, or otherwise moved toward curtains 9 so the material is crushed against the plurality of curtains 9. The curtains 9 may be considered anvils, plates, aprons, breakers, or other members that are sized and shaped to crush material that is pushed or thrown against the members via the rotating mechanism 7. The size, shape and configurations of the curtains may be any of a number of different options to meet a desired design objective. For instance, the curtains could be polygonally shaped members or rounded members. The curtains may have liners attached thereto that are configured to provide a desired hardness or crushing capability for the curtains.

The curtains 9 are connected to the frame 1. The spacing between the curtains 9 and the rotating mechanism 7 defines a space 6 through which material may be moved to crush the material and for material that is sufficiently crushed to pass through an outlet opening. The outlet opening may be below a bottommost curtain. At least one of the curtains may be moveable away from the rotor and toward an outer portion of the frame.

A hydraulic system 17 may be connected to at least one or more of the curtains 9. The curtains 9 may include a first curtain 13, a second curtain 14 and a third curtain 15. Each curtain may be connected to the frame 1. The first curtain may be positioned above the second and third curtains. The second curtain 14 may be positioned between the upper first curtain 13 and lower third curtain 15. The curtains 9 may define a space 6 between the curtains 9 and the rotating mechanism 7 to crush material that passes through that space 6. The space may be a passageway for the material or may at least partially define a path of movement through the crusher 1 for the material being crushed. The width of at least a portion of the space 6 may be adjusted by movement of one or more of the curtains.

The first curtain 13 may be connected to the frame by cylinders such as hydraulic cylinders 21. The cylinders 21 may permit the first curtain 13 to move from an extended position to a retracted position. The retracted position of the first plate 13 may be defined by a stop 21*a* defined on the piston of each of the hydraulic cylinders 21.

The second curtain 14 may be connected to the third curtain 15. For instance, the second curtain may be hingedly connected to the third curtain via a hinge connection mechanism 19 or other type of pivotal connection. The hinge connection may be defined by one or more pins or other pivotal connection between the second and third curtains so that the third curtain 15 may rotate relative to the second curtain 14, the second curtain 14 may rotate relative to the third curtain 15, or so that the second 14 and third 15 curtains may both rotate relative to each other.

The second curtain 14 may also be connected to the frame via one or more cylinders, such as hydraulic cylinders 31. The second curtain 14 may be moved from a retracted position to an extended position. The pistons of the cylinders 31 may have stops 31*a* formed thereon to define a retracted position for the second curtain. The second curtain may also be extended to an extended position via the cylinders 31.

One or more hydraulic cylinders 33 may also be connected between the second curtain 14 and the third curtain 15. The one or more second cylinders 33 may each be a hydraulic cylinder. A receptacle portion of each cylinder 33 may be attached to the second curtain 14. The moveable shaft of each cylinder 33 may be connected to the third curtain 15.

Another set of cylinders 35 may connect the third curtain 15 to the frame 3. The cylinders 35 may be hydraulic cylinders. The pistons of the cylinders 35 may have a stop formed thereon to define a maximum extended position for the third curtain 15 to prevent the third curtain 15 from contacting rotating mechanism 7. The cylinders 35 may be positioned adjacent to a bottom portion of the third curtain 15. The movement of the second curtain 14 and the cylinders 33 and 35 may define a retracted position for the third curtain 15.

In alternative embodiments, it is contemplated that the cylinders 35 may not be utilized. Instead, one or more bars, rods or members may be connected to the third curtain 15 to function as a guide that defines a path along which the bottom portion of the curtain 15 may move along when the curtain 15 is moved via movement of the second curtain 14, cylinder 33 or movement of both the second curtain 14 and the cylinder 33. The guide may also include a mechanical stop that prevents contact between the third curtain 15 and the rotating mechanism 7 under all operating conditions. The mechanical stop may be integral with, positioned on or adjacent to the one or more bars, rods or elongated members of the guide to define the extended position or extended-most position for the third curtain 15.

It should be understood that movement of the curtains 13, 14 and 15 to a retracted position may position those curtains closer to the outer portion of the frame 3 and make the space 6 between the curtains and the rotating mechanism 7 wider. The passageway for the material being crushed by the crusher 1 may then be made wider by movement of the curtains to retracted positions. Movement of the curtains 9 to their extended positions may make the space 6 narrower so that the passageway through which material being crushed moves is narrower when the curtains 9 are in an extended position relative to their retracted position. The movability of the curtains 9 permits the width of the passageway to be adjusted to meet a particular crushing objective for the crushing of material fed to the crusher 1.

The hydraulic system 17 of the crusher 1 may include a storage tank of hydraulic fluid 51 that is connected to at least one pump, such as pump 53*a* and pump 53*b*. Each pump may be connected to a respective control valve. For instance, a first pump 53*a* may be connected to control valve 62 and a second pump 53*b* may be connected to a control valve 61. Each control valve may control the pressure provided by the pumps or the fluid flow rate provided by the pumps. Fluid may be pumped from the storage tank 51 to the cylinders 31 and 33 via the pumps or may provide pressure for movement of the fluid between the cylinders and other elements of the hydraulic system 17.

Of course, the hydraulic system 17 includes conduits such as piping, valves or other connector elements for connecting the fluid of the hydraulic system so the fluid can move to other elements of the system. Such connections may be considered hydraulic linkages or hydraulic connections. The fluid of the system may be oil, such as hydraulic oil, or other fluid that may be suitable for use in hydraulic systems. The conduits or connectors may be positioned and sized and configured to permit that fluid to flow to different elements of the system 17.

The cylinders 31 may be connected to one or more detectors 41 such as one or more linear variable differential transformers (LVDT) or other detectors to detect how much the piston or shaft of the cylinders 31 may move. The one or more detectors 41 may be a sensor that is configured to determine or sense when the pistons of the cylinders 31 has moved to a particular location or may be configured to determine the position of the pistons of the cylinders 31 so that a position of the second curtain 14 may be determined.

At least one detector or sensor 43 may also be connected to the cylinders 33 to determine the position of the pistons of the cylinders 33. The at least one sensor 43 may be configured to determine whether the piston is at a particular position or may be configured to determine each position to which the piston of the cylinders 33 may move.

At least one detector or sensor 45 may also be connected to cylinders 35. Each detector or sensor 45 may be a linear variable differential transformer (LVDT) or other detector to detect how much the pistons or shafts of the cylinders 35 may move. The sensors 45 may be a detector that is configured to determine or sense when the pistons of the cylinders 35 have moved to a particular location or may be configured to determine the position of the pistons of the cylinders 35 so that a position of the third curtain 15 may be determined.

A controller or other elements of an automated process control mechanism may be connected to the sensors or detectors 41, 43 and 45 to communicate with the sensors or detectors and monitor the hydraulic system. The controller may also be connected to other elements of the hydraulic system or sensors attached thereto to actuate functions or to oversee or monitor the functioning of those elements. The controller may receive measurement input or other input from sensors or detectors connected to the cylinders 31, 33, and 35, the curtains, or to other elements of the crusher device 1 to determine positions of the curtains or whether other conditions exist during crushing operations of the crusher device 1. The controller may be connected to at least one computer so that a user may oversee and control the operations of the hydraulic system via an automated process control application running on the computer.

The hydraulic system may also include at least one accumulator 58 that is connected to the one or more cylinders 33. The one or more accumulators 58 may be configured to receive fluid that may be pushed out of the at least one cylinder 33 when the piston of the at least one cylinder 33 is retracted. Alternatively, the accumulators 58 may not be utilized and the fluid from the at least one cylinder 33 may be moved to the storage tank 51 via piping and valves.

The hydraulic system 17 may be configured so that when an uncrushable element passes through the passageway defined by the space 6 between the curtains 9 and the rotating mechanism 7, the curtains are moved away from the rotating mechanism 7 and toward the outer portion of the frame 3 to widen the space 6 that defines the passageway for the material. The widening of the passageway may permit the uncrushable element to pass through the crusher device more quickly and can reduce the pressure the elements of the crusher device may experience when attempting to crush the uncrushable element as that element passes through the crusher device.

When an uncrushable element passes through the space 6, the second curtain 14 is retracted quickly by the great force created via the presence of the uncrushable element. This creates a high pressure in the receptacle of the cylinders 31 and forces fluid to be quickly expelled from those cylinders 31. The fluid may be moved to accumulators (not shown) connected to the cylinders 31 or may be moved to the storage tank 51.

In the event an uncrushable element passing through the space 6 generates a sufficient amount of force such that the pressure in the hydraulic system is at or above a predetermined pressure threshold value, fluid may be fed to the cylinder 33 to retract the piston of the cylinder to move the third curtain 15 about the pivotal connection 19 between the second curtain 14 and third curtain 15 such that the third curtain rotates rearwardly and upwards to retract the third curtain 15 and make the space 6 between the third curtain 15 and the rotating mechanism 7 wider to reduce the pressure and help the uncrushable element pass through the crushing device.

The fluid fed to the cylinder 33 to move the third curtain due to the presence of the uncrushable element may be fluid expelled from the cylinder 31 such that cylinder 33 is automatically retracted to move the third curtain in the event an uncrushable element passes through the crusher. In other embodiments, the fluid may be fluid from the storage tank 51 that is fed to the cylinder 33 via a pump. The fluid may pass through a check valve 59*a* to prevent the fluid fed to the cylinder 33 from moving backwards after the uncrushable element has passed and the pressure in the system significantly drops so that when the fluid is expelled from the cylinder 33 to move the third curtain to a more extended position, the fluid will move to the tank 51 via a different route or to one or more accumulators 58 to store the fluid.

Movement of the fluid will now be discussed more specifically as it relates to the hydraulic system 17 shown in FIG. 3. Under normal operating conditions, each cylinder is filled with fluid on both sides of the cylinder's piston. One side, such as the operating side, may be maintained at a predetermined pressure to resist the forces experienced during normal crushing that may occur via the curtains 9 and rotating mechanism 7. For example, in cylinder 31, the operating side would be side 31*c* and the opposite side 31*d* would be pressurized to maintain the position of the curtain 14. The position of the cylinder the operating pressure in 31*c* are constantly or regularly monitored to maintain set operating parameters such as maintaining the piston of the cylinder at a desired location or maintaining the pressure in the different sides 31*c* and 31*d* of the cylinder 31 at a desired value or within a range of desired values. In some embodiments, any or all of the cylinders may have a return spring. The return springs may permit the fluid within the cylinder portions retaining the return spring to not be under substantial pressure for normal operation and therefore reduce the costs associated with portions of the hydraulic cylinder. The return spring therefore provides the majority of force, if not all the force, for maintaining a position of a cylinder at a desired location and adjustment of the fluid in the portion of the cylinder that does not include the return spring may be the sole or primary way for adjusting the position of those cylinders. It is contemplated that the use of cylinders with return springs may greatly reduce the costs associated with embodiments of the crusher device and may reduce the capacity requirements for some components of the crusher device's hydraulic system.

Pump 53*b* is connected to the storage tank 51 and may pump fluid from the storage tank to cylinders 31 to provide fluid to a receptacle portion 31*c* of each of the cylinders 31 for extending the pistons of the cylinders 31. If the cylinders 31 are extended, fluid may be pushed out of other portions 31*d* of the cylinders. The fluid from portions 31*d* that is expelled from an extension of the pistons from cylinders 31 may be moved back to the storage tank 51 via a control valve 61 or via another path.

In the event the hydraulic system 17 experiences tramp or pressure at or above a pressure threshold, fluid may be automatically directed from cylinder operating side 31*c* to cylinder side 33*a* of cylinder 33 via valve 59. The movement of fluid to cylinder side 33*a* of cylinder 33 retracts the piston of the cylinder 33 and moves the third curtain. Retraction of the piston of the cylinder 33 also forces fluid out of portion 33*b* of the cylinder 33. That fluid flows to one or more accumulators 58 or to the storage tank 51 via a relief valve 55 that may be opened for the storage tank 51 to receive that fluid.

Retraction of the piston of cylinder 33 may move the third curtain. For instance, the third curtain 15 may rotate about pivotal connection 19 to move away from the rotating mechanism 7 and toward the second curtain 14. Such movement may be a backwards and upwards rotational movement. The movement of the third curtain 15 via cylinder 33 or set of cylinders 33 may automatically open area 6 of the crushing area to allow tramp or other types of uncrushable elements to pass through the crusher device by moving the third curtain away from the rotating mechanism 7.

In alternative embodiments, a relief valve 55 may be opened and another pump 53*a* may be activated upon a detection of the presence of the tramp or the pressure threshold being reached or passed. The pump 53*a* may be utilized to move fluid to the at least one cylinder 33 to retract the piston of the at least one cylinder 33. For instance, if only one cylinder 33 is utilized, the fluid may move via pump 53*a* through a control valve 62 and a check valve 59*a* into a portion 33*a* of the cylinder 33 to retract the piston of that cylinder. Retraction of the piston of cylinder 33*a* may move the third curtain 15 so that the third curtain 15 rotates in an upwards and backwards direction toward the second curtain 14 by rotating about pivotal connection 19. Of course, if multiple cylinders 33 are used, the fluid would move to the portion 33*a* for each of the cylinders 33 to retract the pistons of those cylinders. Retraction of the piston of the cylinder 33 also forces fluid out of portion 33*b* of the cylinder 33. That fluid flows to one or more accumulators 58 or to the storage tank 51 via the open relief valve 55.

When tramp or another uncrushable element has passed through the crusher device and the pressure is dropped below the pressure threshold, the relief valve 55 is closed. When the tramp or uncrushable element has passed, fluid may automatically return from cylinder portion 33*a* to cylinder portion 31*c* via valve 59*a*. Alternatively, the crusher device may be designed so all the fluid returns to tank 51 and a pump causes fluid to flow to portion 31*c* to extend the cylinder 31. The fluid fed via the pump may be provided based on measurements or readings provided by sensors 41, 43 and 45 and predetermined parameters. The provided fluid may be directed to cylinders 31, 33 and 21 as necessary to achieve the desired operating positions or to reach a desired operational parameter. For instance, fluid may be directed to these cylinders via one or more pumps 53*a* and 53*b* and valves 61 and 62.

Figure 4:
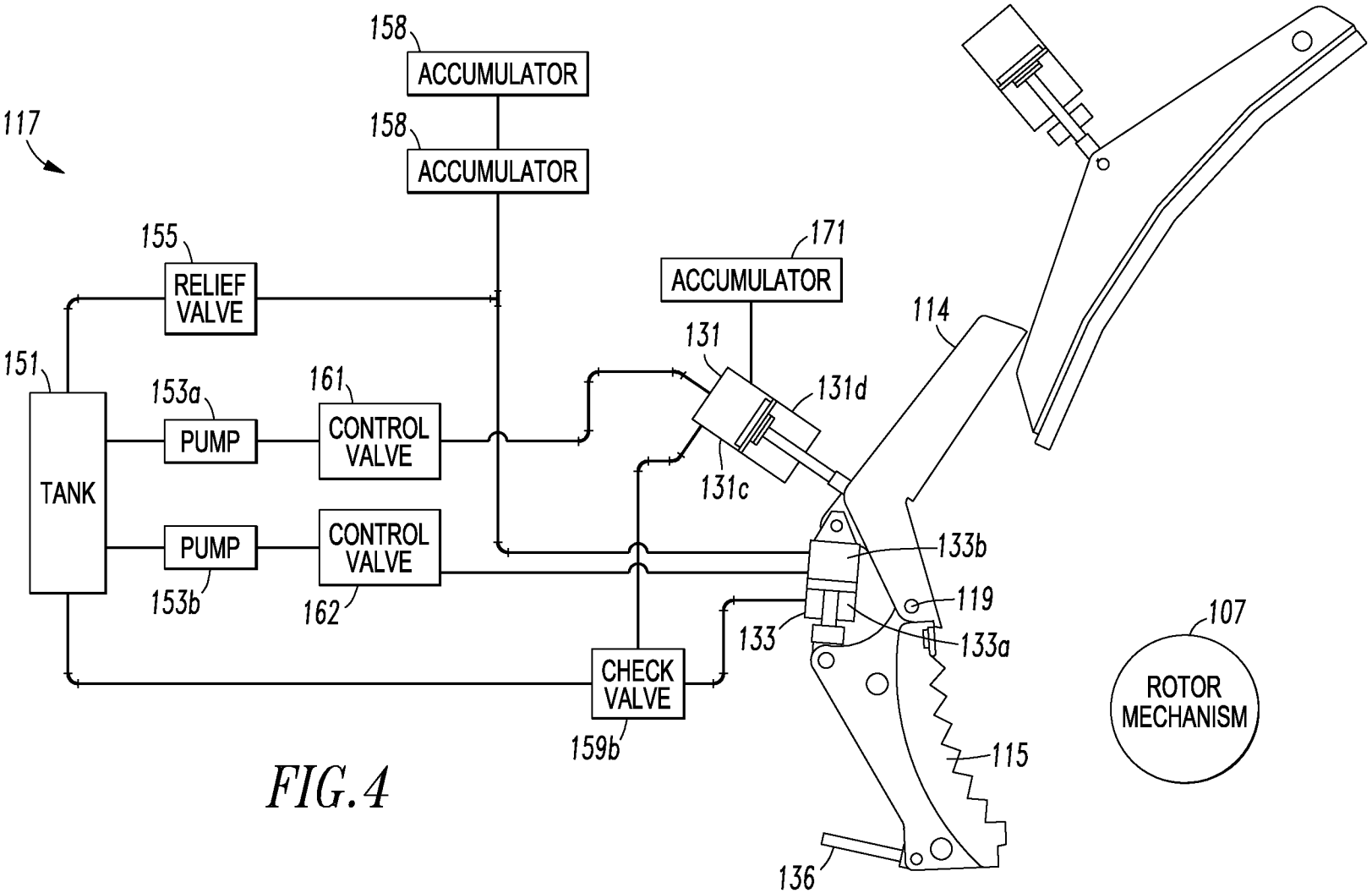
FIG. 4 is a schematic view of a second present preferred hydraulic system that may be used in embodiments of the crusher device.

Referring to FIG. 4, a contemplated alternative embodiment of a hydraulic system that may be utilized in embodiments of the crusher device may include a storage tank 151 that is connected to a first pump 153*a* and a second pump 153*b*. A relief valve 155 may also be connected to the storage tank 151. Control valves 161 and 162 may be connected to respective ones of the first and second pumps 153*a* and 153*b*. The first pump 153*a* may be connected to a portion of a plurality of cylinders 131 to control a position of a second curtain 114, which is spaced from a rotor mechanism 107. The first pump 153*a* may provide a predetermined amount of pressure so that a portion 131*c* of each cylinder 131 is maintained in a desired operating condition and position. Maintaining the position of the piston of the cylinder may maintain a position of the curtain 114 in a desired location.

Cylinder area 131*d* may be filled with fluid to maintain the correct operation position or alternatively a return spring may be positioned in cylinder area 131*d* so that the piston is always positioned against the fluid in portion 131*c* of the cylinder. In the event a return spring is utilized, then the volume of fluid in the cylinder area 131*c* may be varied to achieve the correct operating parameters. Fluid may still be positioned in cylinder area 131*d* even if a return spring is used. However, that fluid may not be under sufficient pressure to control the position of the piston of the cylinder 131. Instead, the return spring may provide the force that acts against the pressure provided by the fluid in cylinder area 131*c*. Since the fluid in portion 131*d* is not required to be of sufficient pressure to control the position of the cylinder, elements of the hydraulic system may be utilized that have a lower cost and provide for a less complex hydraulic system.

When an uncrushable element or other event occurs that pushes against the curtain 114 and is able to retract the curtain 114 the pistons of the cylinders 131 retract and expel fluid from the portions 131*c* of the cylinders 131. That fluid moves through a valve 159*b*. The valve may be set at a first position so that the expelled fluid from portions 131*c* moves toward a portion 133*a* of a cylinder 133 connected between curtain 114 and 115. The addition of this fluid retracts the piston of the cylinder 133 and causes the curtain 115 to move rearwardly and backwardly about a direct pivot connection 119 between the curtains 114 and 115.

In some contemplated embodiments, portion 133*b* of the cylinder 133 may include a return spring. The return spring may act similarly to the return spring discussed above with reference to cylinder 131. Even if a return spring is used, fluid may still be provided in portion 133*b* of the cylinder 133.

The retraction of the piston of the cylinder 133 causes fluid to be expelled from portion 133*b* of the cylinder 133. The expelled fluid is moved to one or more interconnected accumulators 158. If the accumulators 158 are fully filled, the fluid may alternatively be moved to the tank 151 via a valve 155 connected to the tank. The valve 155 may be opened upon a detection of the piston of the cylinder 131 retracting or may be opened upon a detection of the accumulators 158 being unable to receive more fluid.

When an uncrushable element has passed through the crusher, fluid may flow from the accumulators 158 to the portion 133*b* of the cylinder 133. The piston of the cylinder 133 may then extend so that the position of curtain 115 may be adjusted via movement about the pivot connection 119. The extension of the piston may cause fluid in portion 133*a* to move out of the cylinder 133 and toward the portion 131*c* of the cylinder 131 via check valve 159*b*. If the fluid from the accumulators is insufficient for moving the piston of the cylinder 133 to a desired extended position, additional fluid may be provided. For instance, a pump 153*b* may be activated to provide pressure for providing fluid from tank 151 to the portion 133*b* of the cylinder to further extend the cylinder 133.

If the position of the cylinders 131 need further adjusted after movement of the fluid from portion 133*a* toward portions 131*c* of the cylinders 131, then the pump 153*a* may be adjusted or actuated to provide additional pressure for fluid to flow from the tank 151 to the portion 131*c* of the cylinder to further extend the cylinder to position the curtain 114 in a desired location.

An accumulator 171 may also be connected to the cylinders 131 to provide additional fluid to the cylinders if needed. The accumulator may be connected to portion 131*c*. An accumulator (not shown) may also be connected to portions 131*d* of the cylinders 131.

Figure 5:
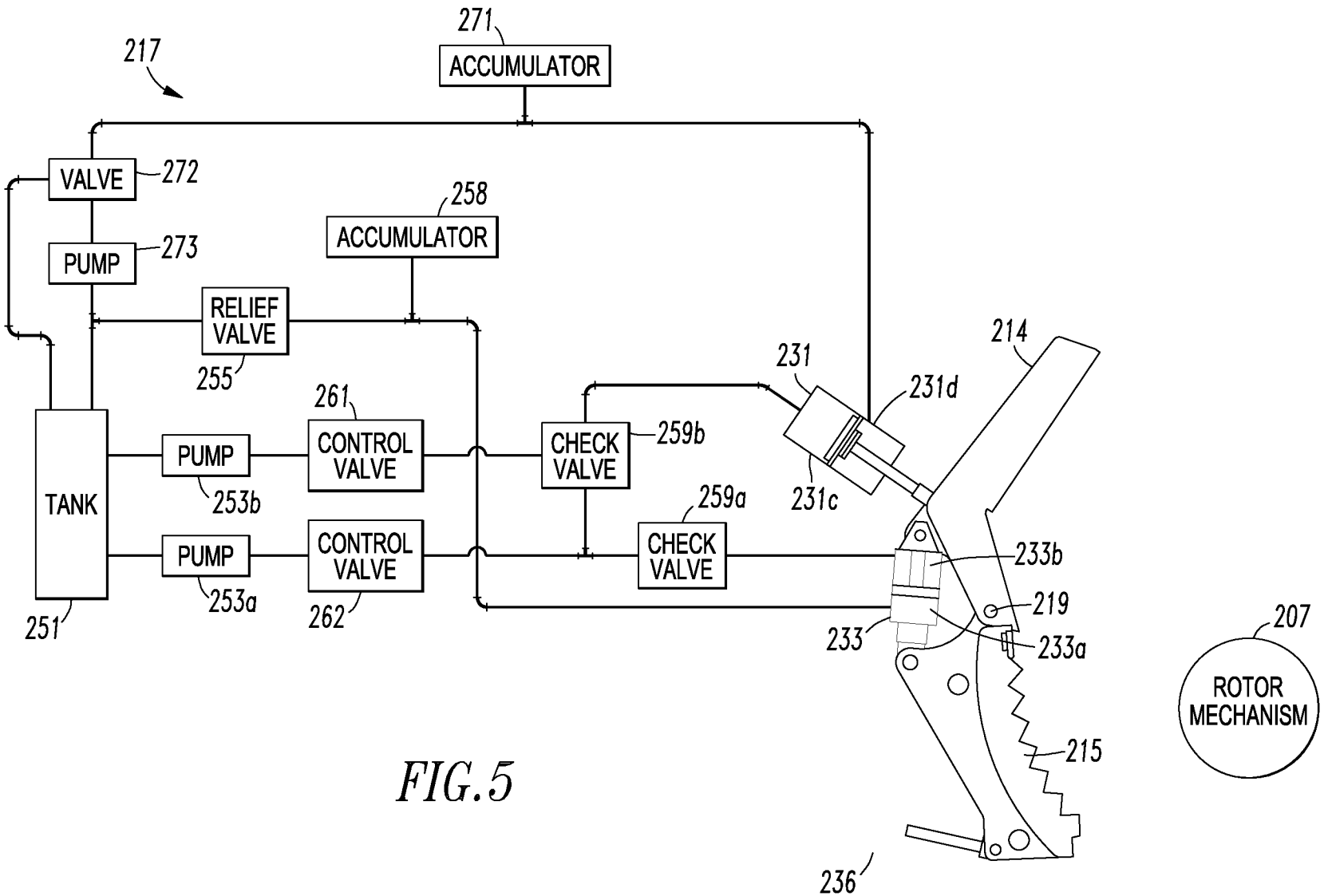
FIG. 5 is a schematic view of a third present preferred hydraulic system that may be used in embodiments of the crusher device.

Yet another alternative embodiment of the hydraulic system 217 that may be used in embodiments of the crusher device is illustrated in FIG. 5. A first curtain 214 may be connected to at least one first hydraulic cylinder 231. A detector 241 may be connected to the each of the first cylinders 231 to determine a position of the cylinders 231 or curtain 214. The first curtain 214 may be pivotally connected to a second curtain 215 via at least one pivotal connection 219. The pivotal connection may be a direct connection of the first curtain 214 to the second curtain 215. The curtains 214 and 215 may be spaced apart from a rotating mechanism 207.

At least one second cylinder 233 may be connected between the first curtain 214 and second curtain 215. The piston of the cylinder 233 may be connected to the first curtain 214. The receptacle that the piston of the cylinder 233 extends from or retracts into may be connected to the second curtain 215. In alternative embodiments, the piston of the cylinder 233 may be connected to the second curtain 215 and the receptacle for that cylinder 233 may be connected to the first curtain 214.

At least one member 236 may be positioned adjacent to the bottom of the second curtain to define a path of travel for the bottom portion of the second curtain 215. The second curtain 215 may slide along at least a portion of the member 236. In alternative embodiments, the one or more members 236 may be one or more cylinders.

A storage tank 251 that stores hydraulic fluid such as hydraulic oil may be provided in the hydraulic system 217. A pump 253*b* may be connected to the storage tank 251 so fluid is moveable to a portion 231*c* of each cylinder 231 to extend the piston of the cylinder 231. Fluid from a portion 231*d* of the cylinder 231 may be expelled from the cylinder 231 when the piston is extended and stored in an accumulator 271 or to the storage tank via a valve 272. Fluid may be pumped back into the portion 231*d* via the accumulator 271 or a pump 273 connected to the storage tank 251 to cause the cylinder 231 to retract. Alternatively, the piston of each cylinder 231 may retract when an uncrushable element exerts an excessive force against the first curtain to retract the first curtain.

When the first cylinder is retracted, fluid is expelled from the portion 231*c* of each cylinder 231. The expelled fluid may be stored in one or more accumulators (not shown) connected to the cylinders 231 or may be returned to the storage tank. Alternatively, the fluid may pass through check valves 259*b* and 259*a* to move into portion 233*b* of the cylinder 233 to retract the piston of the cylinder 233. For instance, in the event a predetermined pressure threshold is detected, such as a high pressure that is well over a desirable operating pressure for the hydraulic system, the fluid may be expelled from the cylinders 231 and fed to the cylinder 233 to retract the cylinder 233.

It should be understood that alternative embodiments of the crusher device may replace one cylinder 233 with two or more cylinders. These cylinders may function similarly to cylinder 233 and receive fluid from the cylinders 231 similarly to how cylinder 233 may receive fluid from cylinders 231.

When the cylinder 233 is retracted, the second curtain rotates toward the first curtain 214 and away from the roller mechanism 207 about the pivotal connection 219. The rotational movement may be a generally upward movement in a direction that is away from the rotating mechanism 207 and toward the first curtain 214.

Also, fluid is expelled from the portion 233*a* of the cylinder 233 when the cylinder 233 is retracted. The expelled fluid is stored in one or more accumulators 258 connected to the cylinder 233. If the one or more accumulators are not present or are unable to store more fluid, the fluid may alternatively pass through a relief valve 255 and into the storage tank 251.

A controller may oversee operations of the hydraulic system 217 and may monitor the pressure of the system 217. If the controller detects a pressure that is at or above a pressure threshold, the controller may be configured to open the relief valve 255 and actuate a pump 253*a* so that fluid passes from the storage tank and into the cylinder 233 via check valve 259*a* to retract the cylinder 233. Alternatively, the controller may actuate valves 259*a* and 259*b* so that the cylinder 233 is automatically retracted via movement of fluid from cylinder 231 to cylinder 233 when an undesirable pressure limit is reached or surpassed. Such an undesirable pressure may indicate that an uncrushable element is passing through the crusher device and the retraction of the first and second curtains may be helpful in alleviating the excessive pressure and also help expedite the passage of the uncrushable element by increasing the spacing between the curtains 214 and 215 and the rotating mechanism 207. As noted above, when the cylinder 233 is retracted, fluid passes from portion 233*a* of the cylinder to the one or more accumulators 258 or to the storage tank 251 via relief valve 255.

As one of ordinary skill in the art will appreciate, variations to the design of the hydraulic system of the crusher device may be made to meet various design objectives such as a desired cost of manufacture objective or a desired crushing capacity objective for the crushing device. For instance, the types of accumulators, pumps or cylinders or other elements of the hydraulic system may be any of various different types to meet a particular design objective. The accumulators may be, for example, hydro-pneumatic accumulators, piston accumulators, gas charged bladder accumulators, gas charged piston accumulators, spring loaded piston accumulators, weight loaded accumulators, or gas valve accumulators. As yet another example, the size, quantity, shape or configuration of the accumulators, pumps, valves, or storage tanks may be any of a number of possible options to meet a particular design objective. Similarly, the operational pressure for the cylinders and pressure settings for the accumulators, cylinders and pumps may be any of a number of pressures, range of pressures or pressure settings to meet a particular design objective.

Of course, those of ordinary skill in the art may also appreciate that other variations may also be made to the crusher devices discussed above. For instance, the number of curtains or arrangement of curtains in the crusher device may be adjusted to meet a desired design objective. As another example, the type of rotor or impeller for the rotating mechanism or the use of hammer members may be any of a number of different typical alternatives to meet a design objective. As yet another example, the size and shape of the crusher device and its components may be any of a number of different sizes and shapes to meet a particular design objective.

While certain present preferred embodiments of the crusher device are shown and described and methods of making and using the same have been shown and described above, it is to be distinctly understood that the invention is not limited thereto but may be otherwise variously embodied and practiced within the scope of the following claims.

What is claimed is:

1. A crusher device comprising: a frame; a rotating mechanism positioned in the frame, the rotating mechanism being rotatable to crush material; a plurality of curtains, the curtains positioned adjacent to and spaced apart from the rotating mechanism to at least partially define a passageway along which material moves while being crushed, the plurality of curtains comprising a first curtain and a second curtain; the first curtain connected to the frame via a first cylinder; the first cylinder being moveable from a retracted position to an extended position; the first curtain connected to the second curtain via at least one pivotal connection; a second cylinder connected between the first curtain and the second curtain; and the second cylinder being retractable when the first cylinder is retracted to adjust spacing between the first and second curtains and the rotating mechanism, retraction of the second cylinder rotating the second curtain away from the rotating mechanism and toward the first curtain.

2. The crusher device of claim 1 wherein the crusher device is an impact crusher and wherein the curtains are plates, breakers or aprons.

3. The crusher device of claim 1 wherein the plurality of curtains is comprised of a third curtain that is moveably connected to the frame and positioned above the second curtain and wherein the second curtain is positioned substantially below the first curtain.

4. The crusher device of claim 1 further comprising a storage tank connected to the frame and a pump connected to the storage tank and to at least the second cylinder, the pump being actuatable to adjust a position of the second curtain.

5. The crusher device of claim 1 wherein the first curtain is moveable relative to the second curtain and the second curtain is moveable relative to the first curtain.

6. The crusher device of claim 1 wherein the second cylinder is retracted when a pressure of the crusher device is determined to be at or above a predetermined pressure threshold.

7. The crusher device of claim 6 wherein the first cylinder is connected to the second cylinder such that fluid from the first cylinder flows to the second cylinder to retract the second cylinder via hydraulic linkage connecting the first cylinder to the second cylinder when the pressure is at or above the predetermined pressure threshold and the first cylinder is retracted.

8. The crusher device of claim 1 wherein the first cylinder has a first area and a second area and wherein the second area has a return spring positioned therein and the first area retains fluid therein and wherein adjustment of an amount of fluid within the first area is a sole way of adjusting a position of the first cylinder.

9. The crusher device of claim 8 wherein the second cylinder has a first area and a second area and wherein the second area of the second cylinder has a return spring positioned therein and the first area of the second cylinder retains fluid therein and wherein adjustment of an amount of fluid within the first area is a sole way of adjusting a position of the second cylinder.

10. The crusher device of claim 9 further comprising a guide connecting the second curtain to the frame and at least one mechanical stop positioned adjacent to the guide or on the guide, the mechanical stop preventing the second curtain from moving beyond an extended most position toward the rotating mechanism.

11. An impact crusher comprising: a frame; a rotating mechanism positioned adjacent to the frame, the rotating mechanism being rotatable to crush material; a plurality of curtains positioned adjacent to the rotating mechanism, the curtains and the rotating mechanism spaced apart to at least partially define a passageway along which material moves when being crushed by the impact crusher; the plurality of curtains comprising a first curtain and a second curtain, the first curtain being pivotally connected to the second curtain; a first cylinder connected to the frame, the first curtain being connected to the first cylinder to moveably position the first curtain; and a second cylinder, the second cylinder connected between the first and second curtains, the second cylinder having a piston that is moveable from an extended position to a retracted position, a distal end of the piston being connected to the one of the first curtain and the second curtain; and the piston the second cylinder retracting to the retracted position to automatically move the second curtain away from the rotating mechanism and toward the first curtain when a predetermined pressure threshold is detected.

12. The impact crusher of claim 11 wherein the predetermined pressure threshold is a predetermined amount of pressure or a value greater than a predetermined amount of pressure.

13. The impact crusher of claim 11 wherein the curtains are also comprised of a third curtain positioned above the second curtain.

14. The impact crusher of claim 13 wherein the third curtain is connected to the frame via a third cylinder.

15. The impact crusher of claim 11 wherein fluid from the first cylinder flows to a portion of the second cylinder to retract the piston of the second cylinder to move the second curtain when the predetermined pressure threshold is detected and the first cylinder is retracted.

16. The impact crusher of claim 11 wherein the impact crusher is a horizontal impact crusher.

17. The impact crusher of claim 11 further comprising at least one liner, the at least one liner comprised of a first liner connected to the first curtain.

18. The impact crusher of claim 11 wherein the rotating mechanism is comprised of a rotor connected to a plurality of hammer members.

19. The impact crusher of claim 11 wherein the first curtain is a first polygonal shaped plate and the second curtain is a second polygonal shaped plate.

20. The crusher device of claim 11 wherein the first cylinder has a first area and a second area and wherein the second area has a return spring positioned therein and the first area retains fluid therein and wherein adjustment of an amount of fluid within the first area is a sole way of adjusting a position of the first cylinder.

21. The crusher device of claim 20 wherein the second cylinder has a first area and a second area and wherein the second area of the second cylinder has a return spring positioned therein and the first area of the second cylinder retains fluid therein and wherein adjustment of an amount of fluid within the first area is a sole way of adjusting a position of the second cylinder.

22. The crusher device of claim 21 further comprising a guide connecting the second curtain to the frame and at least one mechanical stop positioned adjacent to the guide or on the guide, the mechanical stop preventing the second curtain from moving beyond an extended most position toward the rotating mechanism.

23. A crusher device comprising: a frame; a rotating mechanism positioned within the frame, the rotating mechanism rotating to crush material; a plurality of curtains positioned adjacent to the rotating mechanism, the curtains and the rotating mechanism spaced apart to at least partially define a passageway along which material moves when being crushed by the crusher device; the plurality of curtains comprising a first curtain and a second curtain, the first curtain being pivotally connected to the second curtain; a hydraulic system comprised of a first hydraulic actuation mechanism and a second hydraulic actuation mechanism; the first hydraulic actuation mechanism connected to the frame, the first hydraulic actuation mechanism also being connected to the first curtain to moveably position the first curtain; and the second hydraulic actuation mechanism connected between the first and second curtains, the second hydraulic actuation mechanism being moveable from an extended position to a retracted position; and the second hydraulic actuation mechanism retracting to the retracted position via fluid moving from the first hydraulic actuation mechanism to the second hydraulic actuation mechanism to automatically move the second curtain away from the rotating mechanism and toward the first curtain when a predetermined pressure threshold is detected.

24. The crusher of claim 23 wherein the first hydraulic actuation mechanism is a first cylinder and the second hydraulic actuation mechanism is a second cylinder, and wherein fluid from the first cylinder is moved from the first cylinder to the second cylinder to retract a piston of the second cylinder, the fluid from the first cylinder is moved to the second cylinder via retraction of the first cylinder.

25. The crusher of claim 24 wherein the hydraulic system is further comprised of a tank storing fluid connected to the frame and at least one pump connected to the tank, the at least one pump comprising a first pump, the first pump being actuated to move fluid from the tank to the second cylinder to retract the second cylinder.

26. The crusher of claim 25 wherein the first pump is actuated after a predetermined pressure threshold is detected or when the predetermined pressure threshold is detected.

27. The crusher of claim 26 wherein the hydraulic system is also comprised of a relief valve that is positioned between the tank and the second cylinder, the relief valve being opened when the first pump is actuated or the relief valve being opened after the predetermined pressure threshold is detected and before the first pump is actuated.

28. The crusher of claim 27 wherein fluid from the second cylinder is moved from the second cylinder to the tank via the relief valve when the second cylinder is retracted.

* * * * *